US006129074A

United States Patent [19]

Frank

[11] Patent Number: 6,129,074

[45] Date of Patent: Oct. 10, 2000

[54] FLANGE OF A FUEL DELIVERY MODULE AND FUEL DELIVERY MODULE

[75] Inventor: Kurt Frank, Schorndorf, Germany

[73] Assignee: Robert Bosch GmbH, Stuttgart, Germany

[21] Appl. No.: 09/424,398

[22] PCT Filed: Mar. 22, 1999

[86] PCT No.: PCT/DE99/00807

§ 371 Date: Nov. 22, 1999

§ 102(e) Date: Nov. 22, 1999

[87] PCT Pub. No.: WO99/49206

PCT Pub. Date: Sep. 30, 1999

[30] Foreign Application Priority Data

Mar. 25, 1998 [DE] Germany ..... 198 13 204

[51] Int. Cl.[7] ..... F02M 37/04

[52] U.S. Cl. ..... 123/509; 123/514; 361/216; 137/569

[58] Field of Search ..... 123/509, 514, 123/510, 497, 459; 361/215, 216; 137/569; 210/243, 446

[56] References Cited

U.S. PATENT DOCUMENTS

| | | | |
|---|---|---|---|
| 5,076,920 | 12/1991 | Danowski et al. | 210/243 |
| 5,078,167 | 1/1992 | Brandt et al. | 123/510 |
| 5,164,879 | 11/1992 | Danowski et al. | 361/245 |
| 5,195,494 | 3/1993 | Tuckey | 123/514 |
| 5,392,750 | 2/1995 | Laue et al. | 123/509 |
| 5,642,718 | 7/1997 | Nakai et al. . | |
| 5,762,047 | 6/1998 | Yoshioka et al. | 123/509 |
| 5,785,032 | 7/1998 | Yamashita et al. | 123/509 |
| 5,887,617 | 3/1999 | Frank | 137/574 |

*Primary Examiner*—Carl S. Miller
*Attorney, Agent, or Firm*—Michael J. Striker

[57] ABSTRACT

To guard against electrostatic discharge in a pressure regulator, a flange of a fuel delivery module for connecting a tank with a fuel feed line of an engine, having a pressure regulator for regulating the pressure in the fuel feed line, and having at least one hookup for an external electrical potential, is characterized in that the flange is embodied in at least some portions of weakly electrically conductive material, in such a way that the hookup is connected conductively with the pressure regulator via the weakly electrically conductive material.

12 Claims, 1 Drawing Sheet

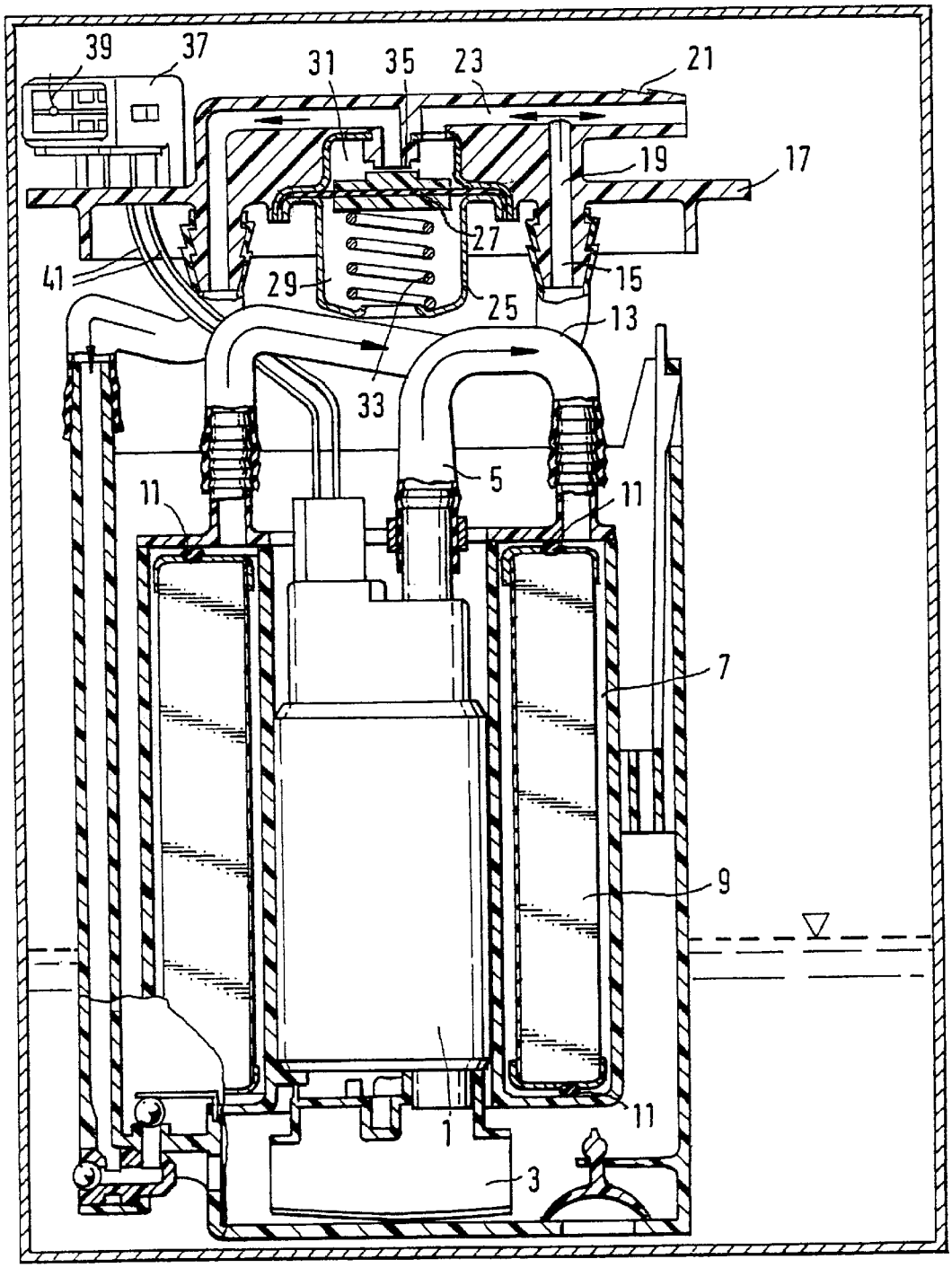
39
37
31
35
23
21
19
17
27
41
29
25
15
13
33
5
11
11
7
9
11
1
3

FLANGE OF A FUEL DELIVERY MODULE AND FUEL DELIVERY MODULE

The present invention relates to a flange of a fuel delivery module, and to a fuel delivery module. Such flanges and fuel delivery modules are used on the tank, especially of motor vehicles, for connecting the tank to the fuel feed line of an engine.

PRIOR ART

One known flange of this kind includes a pressure regulator for regulating the pressure in the fuel feed line. If the pressure to be set is exceeded, the pressure regulator allows fuel to escape through a throttle restriction. Because of the high fuel velocity in the throttle restriction of the pressure regulator, a pronounced charge separation develops, with the threat of very major electrostatic charging of the pressure regulator and its surroundings.

To lessen this danger, it is provided in the known flange that an electric line secured to the pressure regulator housing connects the pressure regulator conductively with a supply line of a fuel pump of the fuel delivery module, to keep the housing of the pressure regulator at a defined potential.

Installing the line between the pressure regulator and the supply line is labor-intensive, and it cannot be precluded that over the course of vehicle operation, the electrical contact between the pressure regulator and the supply line will be lost, either from cable breakage, improper maintenance, or other reasons, allowing electrostatic charges to develop unnoticed.

From U.S. Pat. No. 5,642,718, a fuel delivery module with a flange, a pump secured to the flange, a pressure regulator, and a filter is known. A pump housing made of conductive plastic is insulated from the energy source of the pump, and the flange is of nonconductive synthetic resin.

ADVANTAGES OF THE INVENTION

By means of the present invention, as defined in claims 1 and 11, respectively, a flange of a fuel delivery module and a fuel delivery module are created which have high operating safety despite their simple design.

Advantageous refinements of the flange and the fuel delivery module are defined in claims 2–10 and 12, respectively.

Conductively connecting the pressure regulator to the hookup via the weakly electrically conductive material in accordance with the invention defines the potential of the pressure regulator solely by its being mounted on the flange, without requiring any further steps or parts for assembly. There is thus a cost advantage, because of economies of both working time and parts, and a quality advantage, because the conductive connection, embodied as part of the flange, between the pressure regulator and the hookup cannot come open, for instance if a cable breaks or a plug contact becomes loose.

Where a pressure regulator is disposed in a return line to the tank, if electrostatic charges occur that are not dissipated solely by grounding the pressure regulator, it can additionally be provided that the return line itself is also conductively connected to the hookup.

To that end, the flange is integrally formed of weakly electrically conductive plastic. This may be an essentially arbitrary synthetic resin that is resistant to contact with fuel and that is made conductive by incorporating graphite or metal particles into it. The conductivity of the plastic is expediently adjusted to surface resistance values between $10^3$ ohms and $10^9$ ohms, in order on the one hand to dissipate the electrostatic charges reliably, and on the other so that the mechanical properties of the synthetic resin, which forms a matrix, will not be changed too much by the conductive particles incorporated into it.

The hookup is preferably an electrical leadthrough.

The electrical contact between the leadthrough and the material comprising the flange is advantageously produced by surrounding a conductor of the electrical leadthrough with the weakly electrically conductive material, without insulation. When the flange is produced by injection molding, the electrical leadthrough is preferably embedded in the weakly electrically conductive material.

Further characteristics and advantages of the invention will become apparent from the ensuing description of an exemplary embodiment, in conjunction with the accompanying drawing.

The sole drawing figure shows a fuel delivery module with a flange according to the invention, in cross section.

DESCRIPTION OF THE EXEMPLARY EMBODIMENTS

The drawing shows a fuel delivery module for installation in a tank of a motor vehicle. The module includes a fuel pump 1, which via a filter attachment 3 aspirates fuel from the tank and forces it via an outlet neck 5 into a filter chamber 7, which extends in the form of a hollow cylinder around the pump 1. A filter body 9 is disposed in the chamber 7 and is sealed off at its face ends by O-rings 11. A hose 13 connects the outlet of the filter chamber 7 with a hookup neck 15 on the inside of a flange 17. A fuel passage 19 extends from the neck 15 initially vertically through the flange and horizontally to the right, in terms of the drawing, to an outlet neck 21, which is intended for attaching a fuel feed line leading to the engine. A return line 23, extending to the left in the drawing, connects the fuel passage 19 with a pressure regulator 25, which is secured in a recess on the inside of the flange 17. The pressure regulator 25, in a housing, includes a diaphragm 27 that divides its interior into a fuel chamber 31 and a counterpressure chamber 29. The counterpressure chamber 29 includes a spiral compression spring 33, which presses the diaphragm 27 tightly against a regulator seat 35. Not until the pressure in the fuel chamber 31 exceeds a minimum value does the diaphragm 27 lift slightly away from the regulator seat 35, so that through the throttle restriction that is now opening up, fuel can flow into a downstream portion of the return line 23 and from there back into the tank.

An electrical leadthrough includes a plug connector 37 with two knife contacts 39 and two wires 41 that are connected to the knife contacts and pass through the flange 17. The leadthrough forms a hookup to external potentials of a battery. The plug hookup 37 is integrally molded onto the flange 17, and the knife contacts 39 are spray-coated with the material of the flange to anchor them. The wires 41 are connected to the pump 1, for supplying it with energy.

The flange 17, including the plug hookup 37, comprises a weakly electrically conductive plastic material, such as a synthetic resin matrix with embedded conductive metal or graphite particles. The metal knife contacts 39 are in direct contact with this material, without any insulation in between. In this way, they are conductively connected both to the housing of the pressure regulator and to the entire inside surface of the return line 23. This reliably prevents any accumulation of electrostatic charges along the entire length of the return line 23.

It is already possible, without further provisions, to insulate one of the two knife contacts 39 electrically from the flange 17. This is not absolutely necessary, however. For reliably dissipating the slight electrostatic charges that develop in the return line 23 and on the pressure regulator, even a very slight conductivity of the flange material suffices. It is accordingly not at all difficult to adjust the conductivity in such a way that on the one hand, adequate dissipation of the electrostatic charges is reliably assured, yet on the other, leakage currents through the flange material between the knife contacts are kept so slight as to be technologically insignificant.

As the hookup to an external potential, instead of the plug connector described above, any arbitrary other electrical connection, such as a chandelier terminal, a screw and eyelet connection, or the like can be used. The hookup can also be formed by a conductive screw for fastening the flange to the tank, if the tank is conductive and has a defined electrical potential.

What is claimed is:

1. A flange (17) of a fuel delivery module for connecting a tank with a fuel feed line of an engine, having a pressure regulator (25) for regulating the pressure in the fuel feed line, and having at least one hookup (37, 39, 41) for an external electrical potential, characterized in that the flange (17) is embodied in at least some portions of weakly electrically conductive material, and the hookup (37, 39, 41) is connected conductively with the pressure regulator (25) via the weakly electrically conductive material.

2. The flange of claim 1, characterized in that the pressure regulator (25) is disposed in a return line (23) for returning fuel.

3. The flange of claim 2, characterized in that the hookup (37, 39, 41) is conductively connected to the return line (23) via the weakly electrically conductive material.

4. The flange of claim 1, characterized in that the flange (17) is integrally formed of weakly electrically conductive plastic.

5. The flange of claim 1, characterized in that the surface resistance value of the weakly electrically conductive material is in the range from $10^3$ ohms to $10^9$ ohms.

6. The flange of claim 1, characterized in that the pressure regulator (25) is mounted in a recess that is open toward the inside of the flange (17).

7. The flange of claim 1, characterized in that the hookup (37, 39, 41) is an electrical leadthrough.

8. The flange of claim 7, characterized in that the electrical leadthrough includes at least one conductor (39; 41) that is surrounded, without insulation, by the weakly electrically conductive material.

9. The flange of claim 7, characterized in that the electrical leadthrough (37, 39, 41) includes at least two conductors (39; 41) for supplying energy to a fuel pump (1) disposed on the inside of the flange (17).

10. The flange of claim 1, characterized in that the weakly electrically conductive material is sprayed around electrical contacts (39) of the flange (17).

11. A fuel delivery module having a flange (17) and a fuel pump (1) that is connected to the flange (17) in order to feed fuel through a passage in the flange, characterized in that the flange is a flange of claim 1.

12. The fuel delivery module of claim 11, characterized in that the fuel pump (1) is supplied with energy via the electrical leadthrough (37, 39, 41).

* * * * *